US010883709B1

(12) United States Patent
Huang

(10) Patent No.: US 10,883,709 B1
(45) Date of Patent: Jan. 5, 2021

(54) STRING LIGHTS

(71) Applicant: Lamues Light Enterprise Co., Ltd, Phnom Penh (KH)

(72) Inventor: Kailang Huang, Dongguan (CN)

(73) Assignee: Lamues Light Enterprise Co., LTD, Phnom Penh (KH)

( * ) Notice: Subject to any disclaimer, the term of this patent is extended or adjusted under 35 U.S.C. 154(b) by 0 days.

(21) Appl. No.: 16/691,298

(22) Filed: Nov. 21, 2019

(51) Int. Cl.

| | |
|---|---|
| ***F21V 23/06*** | (2006.01) |
| ***F21S 4/10*** | (2016.01) |
| ***F21V 17/00*** | (2006.01) |
| ***H01R 13/516*** | (2006.01) |
| ***F21V 3/00*** | (2015.01) |
| *H01R 33/88* | (2006.01) |

(52) U.S. Cl.
CPC ..... *F21V 23/06* (2013.01); *F21S 4/10* (2016.01); *F21V 3/00* (2013.01); *F21V 17/002* (2013.01); *H01R 13/516* (2013.01); *H01R 33/88* (2013.01)

(58) Field of Classification Search
CPC ..... F21V 23/06; F21V 3/00; F21V 17/002; F21V 1/00; F21V 17/00; F21V 17/06; F21V 17/08; F21V 17/10; F21V 19/00; F21S 4/10; F21S 4/00; H01R 13/516; H01R 33/88
See application file for complete search history.

(56) References Cited

U.S. PATENT DOCUMENTS

| | | | | |
|---|---|---|---|---|
| 3,609,643 | A * | 9/1971 | Connan | H01R 13/422 439/419 |
| 8,070,347 | B1 * | 12/2011 | Lin | F21V 31/00 362/654 |
| 9,752,763 | B2 | 9/2017 | Lin et al. | |
| 10,100,986 | B2 * | 10/2018 | Lin | F21S 4/10 |
| 10,309,591 | B2 | 6/2019 | Lan | |
| 10,422,486 | B2 | 9/2019 | Zhang | |
| 2016/0215942 | A1 | 7/2016 | Hughes et al. | |
| 2018/0340676 | A1 | 11/2018 | Tsai | |

FOREIGN PATENT DOCUMENTS

| | | | |
|---|---|---|---|
| CN | 105805618 | A | 7/2016 |
| CN | 106122821 | A | 11/2016 |
| CN | 205678443 | U | 11/2016 |
| CN | 107370003 | A | 11/2017 |
| CN | 206723917 | U | 12/2017 |
| CN | 206846401 | U | 1/2018 |
| CN | 304484212 | S | 1/2018 |
| CN | 108224135 | A | 6/2018 |
| CN | 207716102 | U | 8/2018 |
| CN | 201789476 | U | 9/2018 |
| CN | 208222138 | U | 12/2018 |
| DE | 202017101703 | | 5/2017 |
| EP | 3324100 | A1 | 5/2018 |
| WO | WO2019090810 | A1 | 5/2019 |

* cited by examiner

*Primary Examiner* — Bao Q Truong
(74) *Attorney, Agent, or Firm* — Fish IP Law, LLP

(57) ABSTRACT

A string light assembly having a plurality of lighting components is described. Each lighting component comprises a first cover socket, a second cover socket, and a collar for coupling the first and second cover sockets together. When coupled, the first and second cover sockets form a socket housing that has an interior space. The interior space is sized and dimensioned to house an electrical socket. The electrical socket has a cavity with electrical contacts for connecting a light element such as an LED bulb. The lighting component also includes a lampshade that removably couples with the collar.

20 Claims, 4 Drawing Sheets

STRING LIGHTS

FIELD OF THE INVENTION

The field of the invention is lights, more specifically, string light assemblies with removable lampshades.

BACKGROUND

The background description includes information that may be useful in understanding the present invention. It is not an admission that any of the information provided herein is prior art or relevant to the presently claimed invention, or that any publication specifically or implicitly referenced is prior art.

String lighting is a popular choice for both indoor and outdoor lighting and is also commonly used for seasonal decorating. Conventional string lighting assemblies typically comprise a main wired connection line that provides electrical current to a plurality of sockets and lighting elements extending or hanging from the main line. One end of the string has an electrical plug that mates with, and receives electricity from, a power outlet. Optionally, the other end of the string can have another plug for providing power to another string.

Examples of different string light assemblies and lighting elements can be found in U.S. Pat. Nos. 8,070,347, 9,752,763, U.S. Ser. No. 10/100,986, U.S. Ser. No. 10/309,591, U.S. Ser. No. 10/422,486, U.S. Pat. Publ. Nos. US20160215942 and US20180340676, and China Patent Nos. CN105805618B, CN106122821A, CN107370003A, CN108224135A, CN205678443U, CN206723917U, CN206846401U, CN207716102U, CN207893476U, CN208222138U, and CN304484212S. These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

While various string light assemblies are known, there remains a need for a string light assembly that has fewer parts, is easier to assemble, and is more reliable than conventional string light designs. It would also be advantageous to provide a string light that has removable and interchangeable components such as lampshades to change and customize the appearance of the string light assembly.

SUMMARY OF THE INVENTION

The inventive subject matter provides apparatus, systems, and methods in which a string light assembly comprises a wired connection that has two ends. The first end has an electrical connector configured to electrically couple with an electrical power supply and the second end can optionally have an electrical connector configured to electrically couple with, and provide electricity to, another string light assembly. The wired connection comprises a plurality of lighting components extending therefrom at intervals located along a length of the wired connection. It is contemplated that the intervals can be regular (e.g., evenly spaced, repeat pattern spacing) or irregular (e.g., randomly spaced).

Each lighting component comprises two socket covers that join together and form a socket housing that has an interior space. An electrical socket is sized and dimensioned to fit inside the interior space of the socket housing. The socket housing can comprise two arms extending from a body wherein each arm has an opening for receiving a portion of the wired connection. In this manner, the wired connection can pass through the interior space of the socket housing to provide electricity to the socket. In some embodiments, the socket housing can comprise a t-shaped body with two arms extending from the body in different directions and in alignment with one another. However, it is also contemplated that the arms could extend from the body at different angles (e.g., not in alignment).

The electrical socket has a cavity with an electrical connection for connecting a light element such as an LED bulb. When the electrical socket is placed inside the interior space of the socket housing, the cavity of the socket is accessible via an opening in the socket housing.

Each lighting component further comprises a collar sized and dimensioned to fit over a portion of the socket housing. In addition, a light element is configured to electrically and removably couple with the electrical connection in the cavity of the socket. The light element is covered and/or protected by a first lampshade that removably couples with the collar.

Each lighting component can also include a second lampshade that has an opening sized and dimensioned to received the portion of the socket housing that the collar is sized and dimensioned to fit over, while at the same time the opening is smaller than an outer width of the collar. In this manner, the collar can be used to removably secure the second lampshade to the socket housing by first placing the portion of the socket housing through the opening of the second lampshade, and then securing the collar to the socket housing. In some embodiments, the collar has internal threads that are configured to mate with external threads on the socket housing. However, it is also contemplated that non-threaded fasteners, such as press-fit, snap-fit, male/female engagements, and magnetic fasteners can be used in a manner that is consistent with the inventive principles disclosed herein.

In yet other embodiments, the first lampshade can have external threads that mate with the internal threads on the collar. In this embodiment, the internal threads are long enough such that one end of the collar can be used to engage the socket housing while the other end of the collar can be used to engage the first lampshade.

In other aspects, the first and second socket covers that form the socket housing can each comprise a half-shell of the housing. It is also contemplated that the first socket cover and second socket cover can comprise either symmetrical or non-symmetrical portions of the housing.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIG. 2 is a perspective view of the string light assembly of FIG. 1 with the lights turned on.

FIG. 5 is a perspective view of the string light assembly of FIG. 4 with the lights turned on.

DETAILED DESCRIPTION OF THE INVENTION

The following discussion provides many example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

Figure 1:
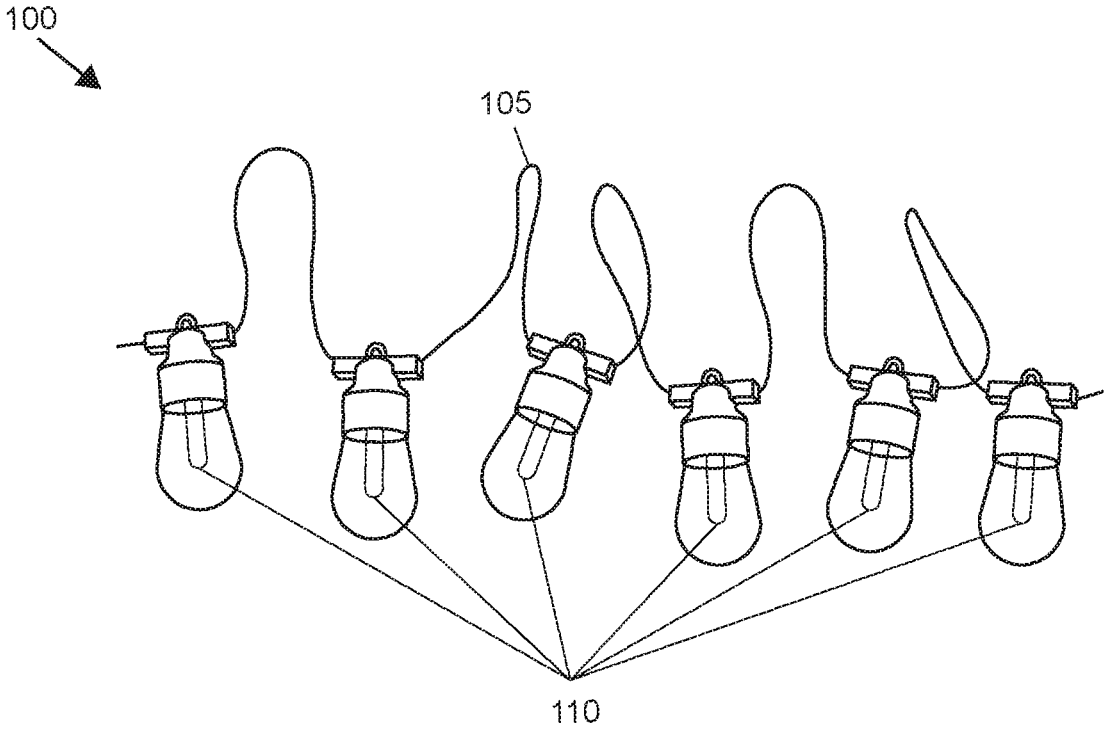
FIG. 1 is a perspective view of a string light assembly.
Figure 2:
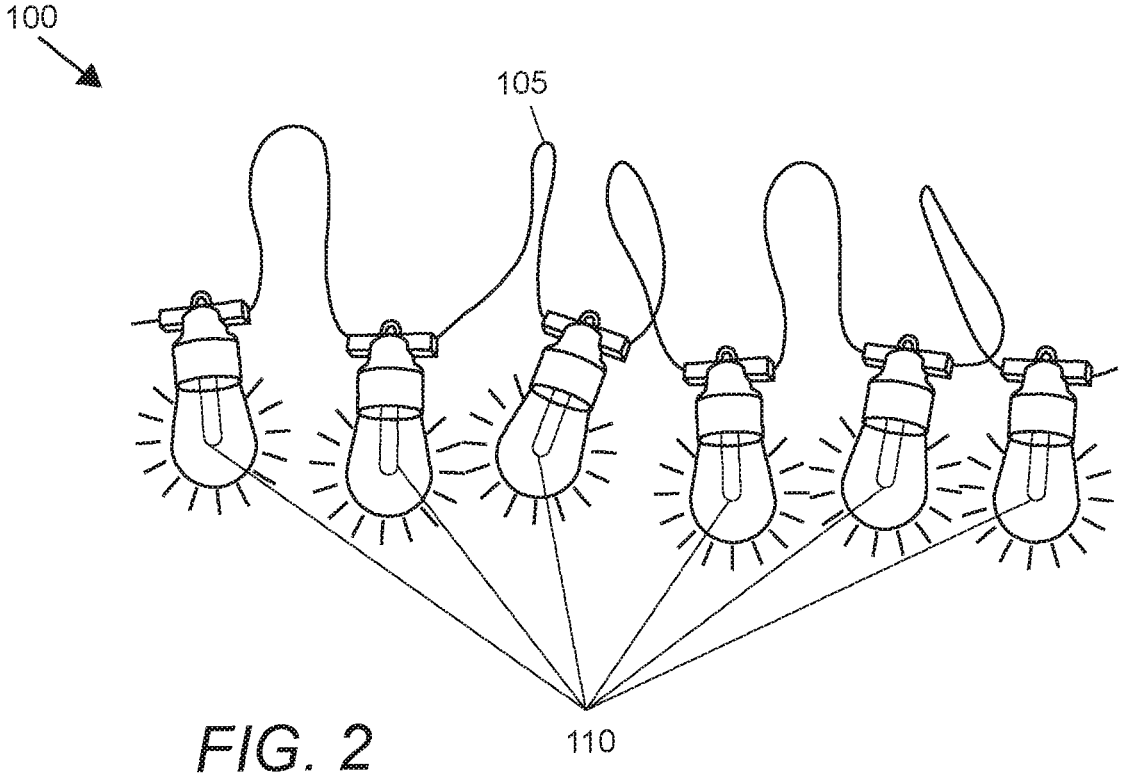

FIG. 1 shows a string light assembly 100 that has a plurality of light components 110 electrically coupled via wired connection 105. A first end of wired connection 105 (no shown) can comprise an electrical plug configured to couple with a power source to provide electricity to the lights 110 for illumination. FIG. 2 shows string light assembly 100 with the light components 110 turned on. A second end of wired connection 105 can include an electrical plug configured to couple with, and provide electricity to, an end of another string light assembly.

Figure 3:
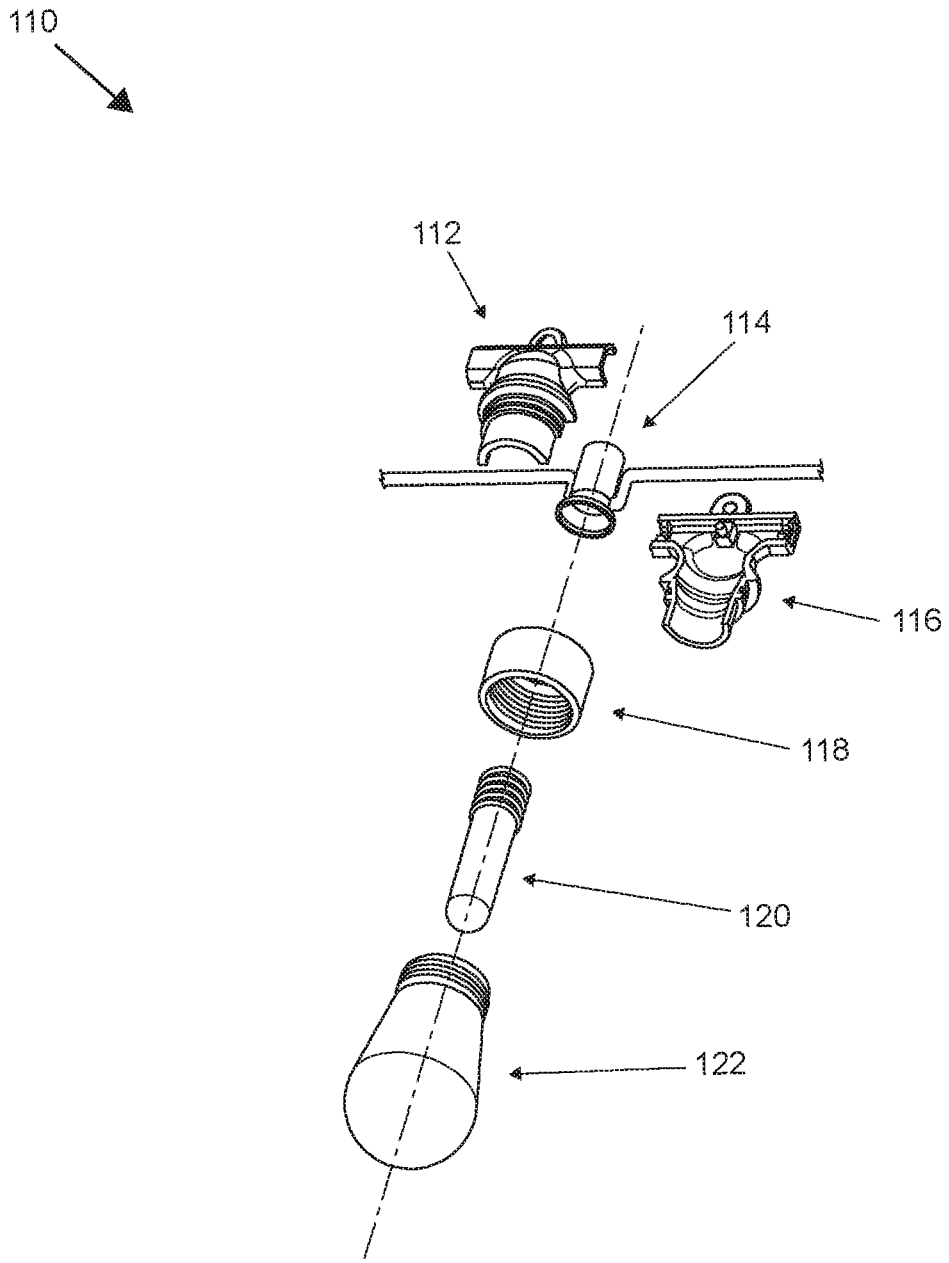
FIG. 3 is an exploded view a bulb assembly of FIG. 1.

FIG. 3 shows an exploded view of a light component 110. Light component 110 comprises a first socket cover 112 and a second socket cover 116 that couple together to form a housing with an interior space. The interior space is sized and dimensioned to enclose an electrical socket 114. First socket cover 112 and second socket cover 116 can be coupled together by screwing the threaded collar 118 onto the external threads of first socket cover 112 and second socket cover 116. It is also contemplated that collar 118 could employ non-threaded fasteners to secure first socket cover 112 and second socket cover 116 together, including male-female engaging connectors, press-fit or snap-in connections, and magnetic fasteners.

First socket cover 112 and second socket cover 116 can be made of plastic, metal, a composite, or any other material suitable for housing an electrical socket and light element. When coupled, first socket cover 112 and second socket cover 116 form a t-shaped housing with two arms extending in different directions. The arms also have openings on their respective ends that allow the two wired connections of socket 114 to pass therethrough.

Socket 114 can be any suitable electrical socket such as parallel XTW or SPT for #20 AWG light string with E12 socket or E17 socket, or parallel XTW or SPT for #18 AWG light string with E17 socket. Socket 114 has a threaded cavity with electrical connections for supplying power to a light element 120. Light element 120 can be any suitable light source, such as E12/E17 incandescent bulbs or LED bulbs. Light element 120 has external threads that mate with the threads of the cavity of socket 114. However, it is also contemplated that light element 120 can removably couple with socket 114 using other known fasteners, including male-female engaging connectors, press-fit or snap-in connections, and magnetic fasteners.

Light component 110 also comprises a lamp shade 122 that removably couples with collar 118 via external threads that mate with the internal threads of collar 118. However, it is contemplated that light component 110 could also be removably coupled with collar 118 using other fasteners. Lampshade 122 has an interior space that is sized and dimensioned to house light element 120 for protection. Lampshade 122 can be made of plastic, metal, or any suitable material for protecting light element 120. Lampshade 122 can also be made of different colors and/or levels of translucency to produce different lighting.

Figure 4:
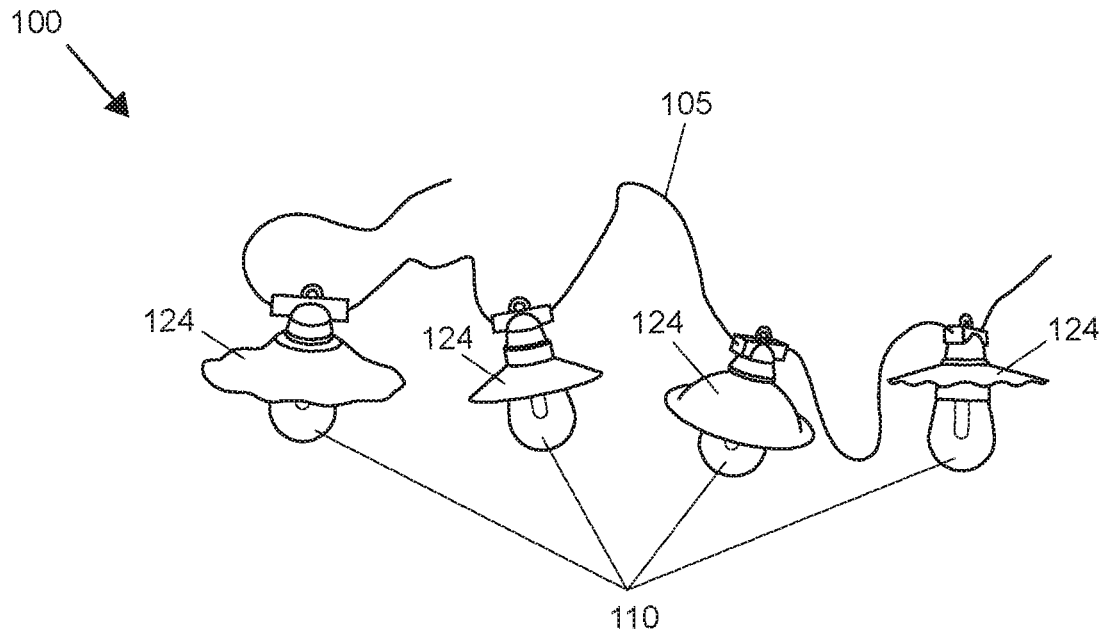
FIG. 4 is a perspective view of the string light assembly of FIG. 1 with a second lampshade.
Figure 5:
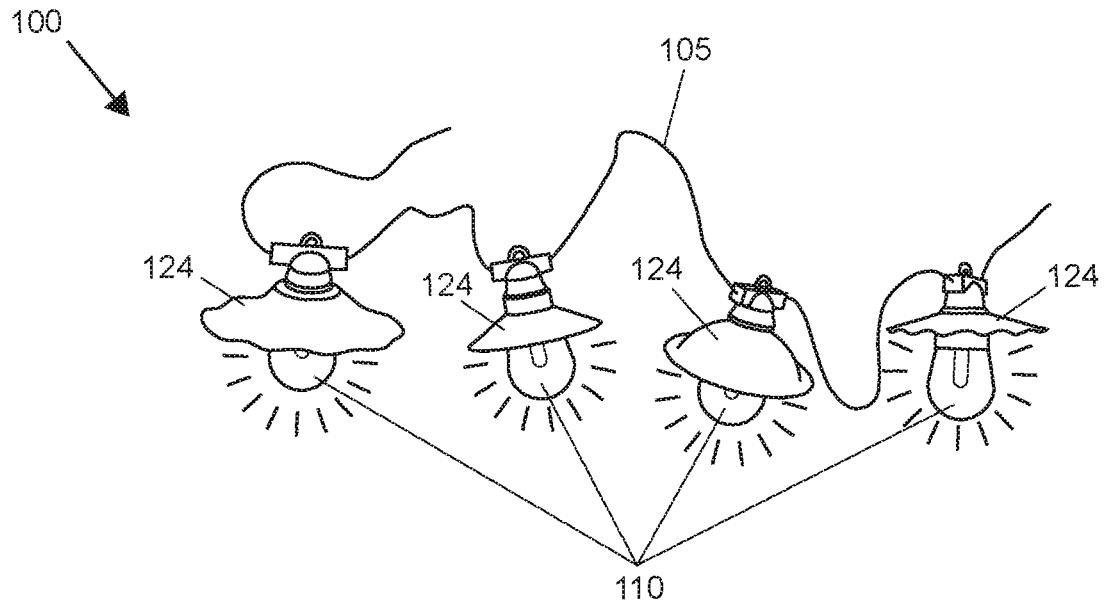

FIG. 4 shows string light assembly 100 with a secondary lampshade 124 removably attached to each light component 110. FIG. 5 shows the string light assembly 100 and secondary lampshade 124 with the lights turned on by a power supply (not shown).

Figure 6:
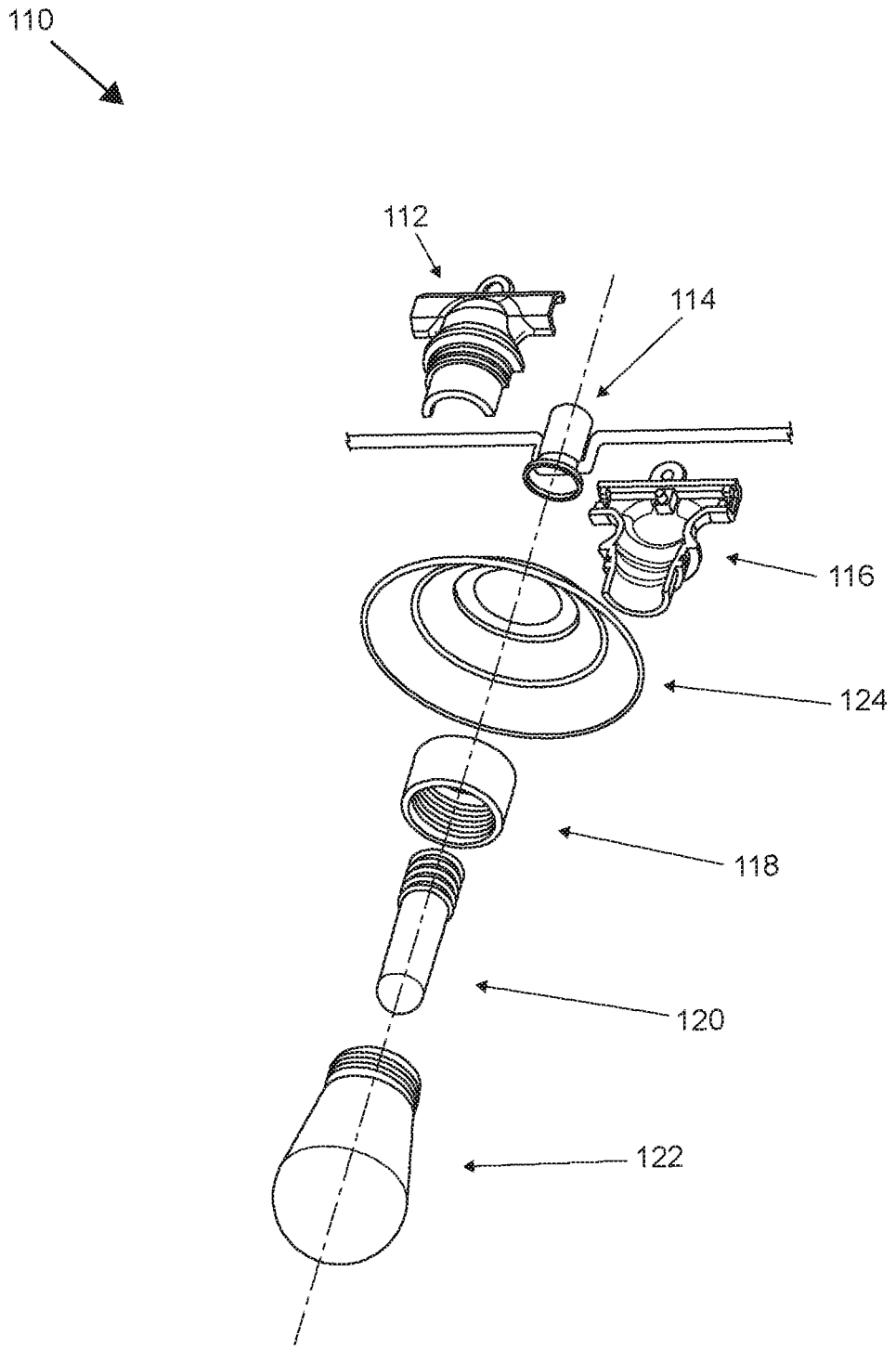
FIG. 6 is an exploded view of the bulb assembly of FIG. 4 with a second lampshade.

FIG. 6 shows an exploded view of string light 100 with the secondary lampshade 124. The parts shown in FIG. 6 are the same as FIG. 3 except for the addition of the secondary lampshade 124. Lampshade 124 removably couples with the first socket cover 112 and the second socket cover 116 by placing the distal end of the t-shaped body through the opening of lampshade 124 and then screwing collar 118 onto the external threads of first socket cover 112 and the second socket cover 116. The size of the opening of lampshade 124 is less than a width or diameter of the housing and the collar. In this manner, collar 118 can be used to secure lampshade 124 to the housing formed by first socket cover 112 and second socket cover 116.

It is contemplated that lampshade 124 can be made of plastic, metal, a composite, or any material suitable for providing shading to a light element. It is also contemplated that lampshade 124 can be made in many different shapes to provide different styles (e.g., outdoor, indoor, modern, rustic, etc.) and can be interchangeable with different shapes and colors of lampshades to create a different style for the string light assembly.

The light component design described herein advantageously allows for different lampshades to be interchangeable to customize the look and feel of the string light assembly. Additionally, the light component design is easy to assemble due to a reduced number of parts. The design can also be used to imitate the effect of an E26 string light, but with the lower cost due to use of an LED bulb.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the spirit of the amended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification refers to at least one of something selected from the group consisting of A, B, C . . . and N, the text should be interpreted as requiring only one element from the group, not A plus N, or B plus N, etc.

What is claimed is:

1. A light component of a string light assembly comprising:

a first socket cover and a second socket cover that removably couple together to form a socket housing having an interior space;

an electrical socket sized and dimensioned to fit inside the interior space of the housing and having a cavity with an electrical connection;

a collar sized and dimensioned to fit over a portion of the housing;

a light element configured to electrically and removeably couple with the electrical connection in the cavity of the socket; and a first lampshade that removably couples with the collar.

2. The light component of claim 1, further comprising a second lampshade that removably couples with the collar.

3. The light component of claim 2, wherein the second lampshade has an opening sized and dimensioned to receive the portion of the housing that the collar is sized and dimensioned to fit over.

4. The light component of claim 3, wherein the opening of the second lampshade is smaller than a width or diameter of the collar.

5. The light component of claim 1, wherein the housing comprises a t-shaped body having first and second arms.

6. The light component of claim 5, wherein the first and second arms each have openings for receiving first and second wired connections of the socket, respectively.

7. The light component of claim 1, wherein the collar has an internal thread.

8. The light component of claim 7, wherein the internal threads of the collar are sized and dimensioned to mate with external threads on the housing.

9. The light component of claim 8, wherein the internal threads of the collar are sized and dimensioned to mate with external threads on the first lampshade.

10. The light component of claim 1, wherein the first socket cover and second socket cover each comprise symmetrical portions of the housing.

11. The light component of claim 1, wherein the socket comprises a body portion and first and second wired connections extending from the body portion.

12. The light component of claim 11, wherein the first wired connection and second wired connection extend away from a longitudinal axis of the body of the socket in different directions.

13. The light component of claim 11, wherein the first wired connection and second wired connection extend from a body of the socket along a same line.

14. A string light assembly comprising:

a wired connection having a first end and a second end, wherein the first end comprises a first electrical connector configured to electrically couple with an electrical power supply and the second end optionally comprises a second electrical connector configured to electrically couple with another string light assembly;

a plurality of lighting elements extending from the wired connection at intervals located along a length of the wired connection;

wherein each lighting component comprises:

a first socket cover and a second socket cover that couple together to form a socket housing having an interior space;

an electrical socket sized and dimensioned to fit inside the interior space of the housing and having a cavity with an electrical connection;

a collar sized and dimensioned to fit over an external surface of the socket housing;

a light element configured to electrically couple with the electrical connection in the cavity of the socket; and a first lampshade that removably couples with the collar.

15. The string light assembly of claim 14, wherein each lighting component further comprises a second lampshade that has an opening sized and dimensioned to receive the portion of the socket housing that the collar is sized and dimensioned to fit over.

16. The string light assembly of claim 15, wherein the opening of the second lampshade is smaller than an outer width of the collar.

17. The string light assembly of claim 16, wherein the opening of the second lampshade is smaller than an outer width of the housing.

18. The light component of claim 1, wherein the first socket cover and second socket cover each comprise a half-shell of the housing.

19. A light component of a string light assembly comprising:

a first socket cover and a second socket cover that removably couple together to form a socket housing having an interior space;

an electrical socket sized and dimensioned to fit inside the interior space of the housing and having a cavity with an electrical connection;

a collar sized and dimensioned to fit over a portion of the housing;

a light element configured to electrically couple with the electrical connection in the cavity of the socket;

a first lampshade that removably couples with the collar; and a second lampshade that removably couples with the collar.

20. The light component of claim 19, wherein the first lampshade removably couples with a first end of the collar and the second lampshade is held in place by a second end of the collar.

* * * * *